United States Patent [19]

Tansley

[11] 3,964,125

[45] June 22, 1976

[54] ELECTROMAGNETIC DOOR HOLDING DEVICE

[76] Inventor: Henry William Tansley, 602 - 1315 Cardero St., Vancouver, British Columbia, Canada, V6G 2J2

[22] Filed: June 12, 1975

[21] Appl. No.: 586,253

[52] U.S. Cl. ..... 16/48.5; 49/1; 49/2; 292/251.5; 292/252; 292/262; 403/32

[51] Int. Cl.[2] ..... E05F 15/20

[58] Field of Search ..... 16/48.5, 49, 78, DIG. 10, 16/DIG. 14; 49/1, 2, 31, 279, 379; 292/251.5, 252, 262; 340/220, 222, 237 S; 403/32

[56] References Cited

UNITED STATES PATENTS

| | | | |
|---|---|---|---|
| 3,415,562 | 12/1968 | Petersen | 16/48.5 X |
| 3,648,326 | 3/1972 | Gaysowski | 16/48.5 |
| 3,729,770 | 5/1973 | Lasier | 16/48.5 |
| 3,729,771 | 5/1973 | Crane et al. | 16/48.5 |
| 3,852,846 | 12/1974 | Slaybaugh | 16/48.5 |
| 3,905,063 | 9/1975 | Coulter et al. | 16/48.5 |

*Primary Examiner*—Werner H. Schroeder
*Assistant Examiner*—Moshe I. Cohen
*Attorney, Agent, or Firm*—Carver and Company

[57] ABSTRACT

An electromagnetic door holding device for a door closer of the type having a spring operated rotating spindle operatively connected by an arm to a slider mounted for reciprocal movement in a track usually secured to the door frame wherein the slider has a cam which when the door is swung to a fully opened position engages and is held by an electromagnet against movement relative to the slider when the door attempts to return to a closed position and which engages and moves a detent carried by the slider into engagement with detent engaging means in the track so as to prevent movement of the slider relative to the track and thus releaseably hold the door in the open position. The energizing of the electromagnet allows the spring to move the cam out of engagement with the detent and thus permit the slider to move and enable the door to move to a closed position.

6 Claims, 5 Drawing Figures

Fig. 1

ELECTROMAGNETIC DOOR HOLDING DEVICE

BACKGROUND OF THE INVENTION

1. Field of the Invention

This invention relates to door closing mechanisms and in particular to devices to allow doors to close automatically in the case of fire, etc.

2. Prior Art

In many public buildings, such as hospitals, it is common practice to use spring operated door closing mechanisms on all fire doors which operate to hold the doors in a normal open position but which are automatically operated by various types of sensing devices to close the doors in the event of fire. Most such devices use a normally energized electromagnet which renders the door closer inoperative when the door is in the open position and which are energized by fire sensing devices in the presence of smoke, fire, etc., to release the door closing mechanism so that the doors will close.

In most mechanisms of this nature, components of the mechanism for obtaining automatic release of the doors are incorporated in the spring closure mechanisms so that if such doors have initially been provided with spring operated door closers only, it is necessary to remove the entire spring closer unit and replace it with the automatic closer device. Conversion to automatically operated devices for all the doors of a building in which the doors have not been so equipped is therefore very costly.

SUMMARY OF THE INVENTION

The present invention provides an automatic door closing mechanism which is simple in construction and operation and which can be used as an attachment to convert a type of door closing which employs a track and guide slideable in the track, for one that will also automatically close the door in case of fire, etc.

The device of the present invention, furthermore, obtains its locking action through mediacy of a cam which is electromagnetically attracted to an energized electromagnet, thus minimizing amount of electrical input required for maintaining the electromagnet in its energized condition.

The present invention comprises a door holdopen and closing assembly with a track adapted to be mounted horizontally to a door frame above a door, the track having detent engaging means, an electromagnet in the track a slider mounted for free sliding movement along the track, a spring operated door closing device adapted to be mounted on the door and having a rotatable arm connected to the slider, a movable cam mounted on the slider operable between a latching and a release position for moving the detent means into and out of corresponding latching and release engagement with the detent engaging means, detent means mounted on the slider for movement into and out of latching engagement with the detent engaging means when the door is in its normal open position, a spring normally urging the cam to its release position, an armature on the cam for engaging the electromagnet when the slider is moved a distance, passed the normal door open position, equal to the travel of the cam between its latching and release positions for holding the cam immovable when the door is returned to the normal open position so that the cam moves the detent means into latching engagement with the detent engaging means so as to prevent movement of the slider in the track and maintain the door in the open position against the action of the door closing device, and normally closed heat sensitive switch means in the electromagnet circuit for opening the circuit upon sensing of heat so as to de-energize the electromagnet to enable the spring to move the cam to its release position out of latching engagement with the detent means and allow the slider to move freely in the track so as to enable the door closing device to return the door to the closed position.

A detailed description following, related to the drawings, gives exemplification of apparatus according to the invention which, however, is capable of expression in means other than those particularly described and illustrated.

DETAILED DESCRIPTION

Figure 1:
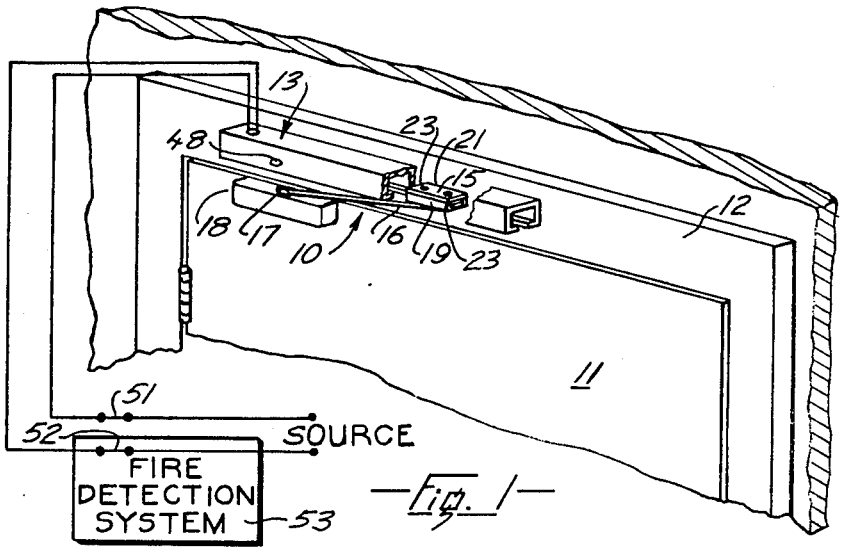
FIG. 1 is a perspective view of door closing and holding mechanism of the invention connected to a door, the latter being shown in a closed position.
Figure 2:
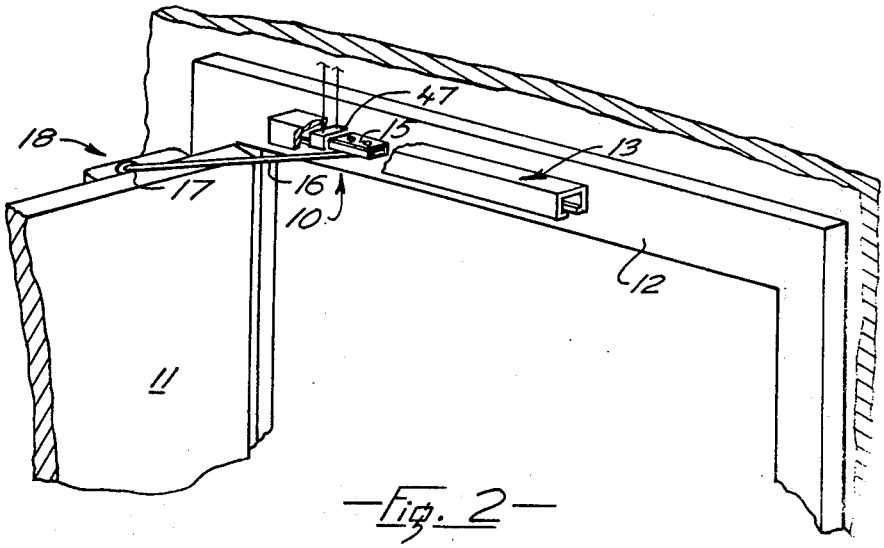
FIG. 2 is a perspective view of mechanism shown in FIG. 1 with the door in an open position.

Referring to the drawings and in particular to FIGS. 1 and 2 a door closing and hold-open assembly 10 is shown in conjunction with a door 11 mounted for hinged movement in a door frame 12, the door being shown in a closed position in FIG. 1 and in an open position in FIG. 2.

The assembly 10 includes a track 13 which is mounted on the door frame 12 above the door within which a slider 15 is mounted for free reciprocal movement. An arm 16 is pivotally connected at one end of the slider and at its opposite end is operatively connected to a spindle 17 of a spring-operated closing mechanism 18 which is mounted on the door. The mechanism is of the type which rotates the spindle in a direction for imparting closing movements to the door and also is provided with a hydraulic retarding mechanism which checks the closing movements of the doors in a preferred manner.

Figure 4:
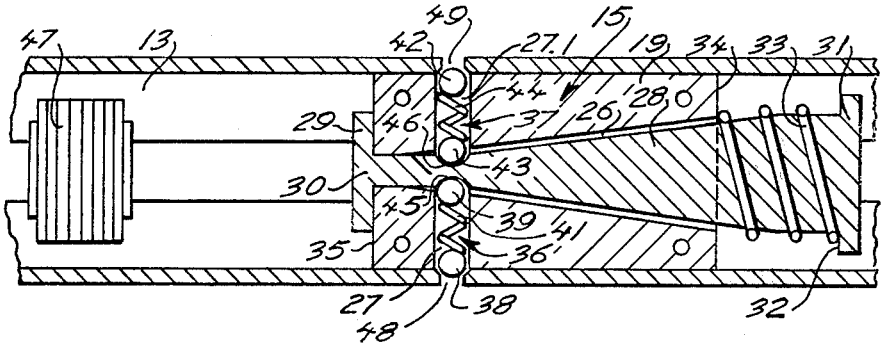
FIG. 4 is a view similar to FIG. 3 showing the slider in a locked position.
Figure 5:
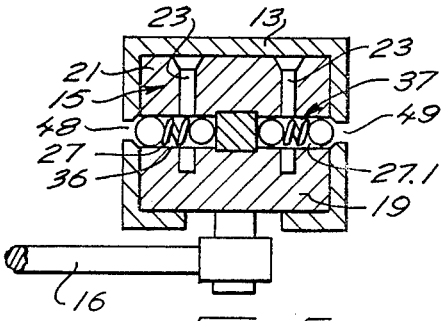
FIG. 5 is a sectional view taken on Line 5—5 of FIG. 3.

The track, seen particularly in FIG. 5, is hollow and is rectangular in cross-section and fittedly receives the slider reciprocal movement of the latter. The slider (FIG. 3 and 4) is of two part construction having a lower block portion 19 and an upper cover portion 21, the two portions being joined by machine screws, 23. The lower block portion 19 is grooved to provide a tapered way 26 which is intercepted near its tapered end by a pair of transverse passages 27 and 27.1. A spear-shaped cam 28 slideably fits in the way 26 and projects from opposite ends of the slider. The cam has an armature 29 at one end 30 and is upset at its opposite end 31 to provide a shoulder 32. A compression spring 33 fits over the cam between the shoulder and one end 34 of the slider and normally urges the cam to slide outwards of the way, movement outwardly being limited by engagement of the armature with the opposite end 35 of the slider.

The transverse passages 27 and 27.1 of the slider hold detent assemblies 36 and 37, respectively. Detent assembly 36 has an outer ball detent 38 which is spaced from an inner ball follower 39 by a compression spring 41. Detent assembly 37 is similarly constructed having a ball detent 42, a ball follower 43 and a compression spring 44. The ball followers are in rolling contact with sides of the spear-head cam and the ball detents are normally thrust outwardly against sides of the track by the compression springs 41 and 44 with the cam in the latching position, as shown in FIG. 3, the compression springs 41 and 44 are fully compressed so that force outwards of the ball detents against the sides of the track is high whereas with the cam in the release position, as shown in FIG. 4, that is with the cam moved outwards by the compression spring 33, the ball followers are received by notches 45 and 46 in the cam thus allowing the compression springs 41 and 44 to extend and thus the pressure outwards of the ball detents against the sides of the track is much reduced.

The assembly 10 includes an electromagnet 47 mounted in the track for engagement by the armature when the door is swung to a position passed its normal open position. The track also has a pair of openings 48 and 49 into which the detent balls are thrust by their associated springs when the slider reaches a position taken by the door in the normal open position as shown in FIG. 4.

The electromagnet (FIG. 1) is connected to a suitable power source by conventional circuitry through a manually operated switch 51 and through a normally closed switch 52 which is automatically opened by sensing of fire by a fire detection system 53.

Figure 3:
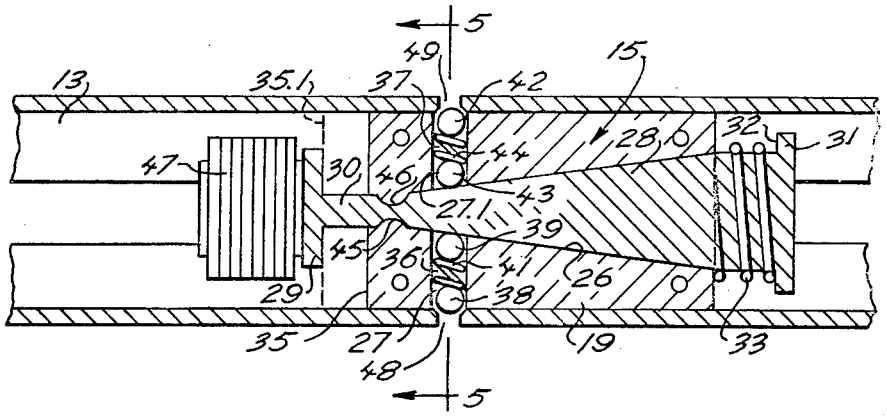
FIG. 3 is a plan view showing a slider partially sectioned in an unlocked or release position.

The electromagnet is positioned in the track so as to be engaged by the armature, with the cam in a release position, when the slider is moved passed the door normally open position, as shown in broken outline 35.1 in FIG. 3, a distance equal to the travel of the cam relative to the slider between its latching and release positions.

In normal operation the electromagnet is in an energized condition, the manually operated switch 51 being closed. With the door closed, the slider is positioned at a point furthest removed from the electromagnet and the cam under the influence of the spring 33, is in its release position with the armature against the end 35 of the slider. In order to releaseably lock the door in its open position, the door is opened until the armature meets the electromagnet. The ball detents are also positioned an equal distance past the holes in the track. The door is then allowed to swing towards its closed position so as to move the slider a distance sufficient to enable the ball detents to engage the track holes. During this latter movement of the slider the cam, which is held stationary by the electromagnet, moves into its latching position as shown in FIG. 3 and moves the ball followers outwards so as to further compress the compression springs 41 and 44. Increased pressure of the springs 41 and 44 against the ball detents seat the latter firmly in the track holes so as to prevent further movement of the slider and thus releaseably hold the door in the open position.

The de-energizing of the electromagnet through operation of the fire detection system, when a fire is sensed, or by manual opening of the switch 51, results in release of the cam which, under the influence of the spring 33, returns to the release position. This, as pointed out, relieves the pressure applied by the compression springs 41 and 42 against the ball detents so as to enable the slider to move freely in the track and allow the door to close under the influence of the door closer.

The door can also be closed manually, if need be, without de-energizing magnet by simply applying a pressure on the door and hence to the slider sufficient to overcome the attraction of the armature and the electromagnet and to break the ball detents clear of the holes in the track. When the armature is clear of the electromagnet the cam automatically returns to its release position so as to relieve pressure on the ball detents and allow the slider to move freely and enable the door to close.

Although the device is shown in conjunction with a door closer in which the arm 16 is an operative part of the closer, it will be understood that the device can be used with doors, equipped for instance with spring hinges for closing the door, in which case the mechanism 18 can be dispensed with and can simply serve as a pivotal support for the arm. Also, it will be appreciated and understood, the track 13 and the electromagnet can be mounted on the door rather than on the door frame in which case arm 16 would be pivotally connected to the door frame. As the above are simple mechanical variations of the invention as described, it is considered that the detailed description thereof is unnecessary.

I claim:

1. A door hold-open and closing assembly comprising:

a. a track adapted to be mounted horizontally to a door frame above a door, the track having detent engaging means, b. an electromagnet in the track, c. a slider mounted for free sliding movement along the track, d. a spring-operated door closing device adapted to be mounted on the door and having a rotatable arm connected to the slider, e. detent means mounted on the slider for movement into and out of latching engagement with the detent engaging means when the door is in its normal open position, f. a moveable cam mounted on the slider operable between a latching and a release position for moving the detent means into and out of corresponding latching and release engagement with the detent engaging means, g. a spring normally urging the cam to its release position, h. an armature on the cam for engaging the electromagnet when the slider is moved a distance, passed the normal door open position, equal to the travel of the cam between its latching and release positions for holding the cam immovable when the door is returned to the normal open position so that the cam moves the detent means into latching engagement with the detent engaging means so as to prevent movement of the slider in the track and maintain the door in the open position against the action of the door closing device, i. normally closed heat sensitive switch means in the electromagnet circuit for opening the circuit upon sensing of heat so as to de-energize the electromagnet to enable the spring to move the cam to its release position out of latching engagement with the detent means and allow the slider to move freely in the track so as to enable the door closing device to return the door to the closed position.

2. A door hold-open and closing assembly as claimed in claim 1 which the detent means comprises:

a. a ball follower engaging the cam and moveable transversely of the slider as the cam is moved between its latching and release positions, b. a ball detent for engaging the track, c. a compression spring between the ball follower and ball detent urging the ball detent against the track so that transverse movement of the ball follower as the cam operates between its latching and release positions correspondingly increases and decreases pressure of the ball detent against the track.

3. A door hold-open and closing assembly as claimed in claim 1 in which the cam is spear-head shaped and including a way formed in the slider for fittedly receiving the cam.

4. A door hold-open assembly for a spring closed door member mounted in the frame member comprising:

a. a track adapted to be mounted in a horizontal position to one of the members, the track having detent-engaging means, b. an electromagnet at one end of the track connected in circuit to a source of electric power, c. a slider mounted for free sliding movement along the track, d. an arm having a rotatable connection to one end of the slider and a rotatable connection at its opposite end with the member on which the track is not mounted, e. detent means mounted on the slider for movement into and out of latching engagement with the detent-engaging means when the door member is in its normal open position, f. a movable cam mounted on the slider operable between a latching and release position for moving the detent means into and out of corresponding latching and release engagement means with the detent engaging means, g. a spring normally urging the cam to its release position, h. an armature on the cam for engaging the electromagnet when the slider is moved a distance passed the normal door open position equal to the travel of the cam between the latching and release positions for holding the cam immovable when the door is returned to the normal open position so that the cam moves the detent means into latching engagement with the detent-engaging means so as to prevent movement of the slider in the track and maintain the door member in the open position against the spring closing action, i. normally closed heat sensitive switch means in the electromagnet circuit for opening the circuit upon sensing of heat so as to de-energize the electromagnet to enable the spring to move the cam to its release position out of latching engagement with the detent means and allow the slider to move freely in the track so as to enable the door member to return to the closed position.

5. A door hold-open and closing assembly as claimed in claim 4 in which the detent means comprises:

a. a ball follower engaging the cam and movable transversely of the slider as the cam is moved between its latching and release positions, b. a ball detent for engaging the track, c. a compression spring between the ball follower and ball detent urging the ball detent against the track so that transverse movement of the ball follower as the cam operates between its latching and release positions correspondingly increases and decreases pressure of the ball detent against the track.

6. A door hold-open and closing assembly as claimed in claim 4 in which the cam is spear-head shaped and including a way formed in the slider for fittedly receiving the cam.

* * * * *